United States Patent [19]

Serbiak et al.

[11] Patent Number: 4,793,941

[45] Date of Patent: Dec. 27, 1988

[54] CLEANING PRODUCT

[75] Inventors: Paul J. Serbiak, Green Bay, Wis.; Edwin G. Greenman, Woodstock, Ga.; Gary L. Shanklin, Appleton, Wis.

[73] Assignee: Kimberly-Clark Corporation, Neenah, Wis.

[21] Appl. No.: 920,494

[22] Filed: Oct. 17, 1986

[51] Int. Cl.[4] ..... C11D 17/00

[52] U.S. Cl. ..... 252/91; 15/104.93; 15/209 C; 252/174

[58] Field of Search ..... 252/91, 90; 428/219, 428/220; 15/104.93, 209 R, 209 C

[56] References Cited

U.S. PATENT DOCUMENTS

| | | | |
|---|---|---|---|
| 4,170,565 | 10/1979 | Flescher et al. | 252/91 |
| 4,307,143 | 12/1981 | Meitner | 252/91 |
| 4,600,620 | 7/1986 | Lloyd | 428/178 |
| 4,683,001 | 7/1987 | Floyd et al. | 15/104.93 |

*Primary Examiner*—Paul Lieberman
*Assistant Examiner*—John F. McNally
*Attorney, Agent, or Firm*—Gregory E. Croft

[57] ABSTRACT

An 11×11 inches meltblown web contains a sufficient amount of condensed liquid detergent to wash a load of laundry and does not exhibit an objectionable sticky feel.

7 Claims, 1 Drawing Sheet

CLEANING PRODUCT

BACKGROUND OF THE INVENTION

Laundry detergents are most commonly available in either liquid or powder form. In order to use such detergents, the user must measure out a certain quantity from a supply bottle or box and pour the measured amount into the clothes washer. In addition, if a fabric softener is desired, the fabric softener must be separately measured or at least separately deposited into the washer or dryer. Such multiple products, containers, and measuring can be messy and, at the very least an inconvenience, particularly for apartment dwellers who must carry all the necessary containers, etc., to the laundry area.

In this regard, the prior art discloses a variety of alternative cleaning products which are intended to provide improved convenience to the consumer. For example, U.S. Pat. No. 4,356,099 to Davies et al. discloses a laundry cleaning product comprising a plastic bag containing a liquid detergent. The bag has a weak seal which is opened by the mechanical action of the washing machine, thereby releasing the liquid detergent.

U.S. Pat. No. 4,188,304 to Clarke et al. discloses a similar detergent product comprising a plastic bag containing a particulate detergent. The bag contains a water-sensitive seal which discharges the contents of the bag when contacted with water.

U.S. Pat. No. 3,686,075 to Morton discloses a sheet substrate containing a fabric softener which is to be preferably used in the clothes dryer, but can also be added to a wash machine during its rinse cycle.

U.S. Pat. No. 4,170,565 to Flesher et al. discloses a laundry product comprising a detergent composition contained between two layers of a water-insoluble permeable substrate such as a polypropylene meltblown web. When contacted by water during the wash cycle, the detergent is dissolved and permeates through the substrate into the wash water. Most significantly, at column 1, lines 56–65, Flesher et al. apparently recognize the potential value of a single layer substrate for delivering laundry detergent, but conclude it is not feasible because of difficulty in loading the substrate with a sufficient amount of detergent and the sticky feel of any product that might be produced.

Therefore there is a need for a laundry cleaning product containing a premeasured amount of detergent which is convenient to use and economical to manufacture.

SUMMARY OF THE INVENTION

In one aspect, the invention resides in a laundry cleaning product comprising a meltblown substrate containing at least 150 grams of condensed liquid detergent per square meter. Preferably, the amount of condensed liquid detergent is at least about 190 grams per square meter, which is the equivalent of ⅛ cup of liquid laundry detergent. A suitable range is from about 190 to about 300 grams per square meter. It has been discovered that meltblown webs possess a unique ability to absorb and hold an amount of liquid detergent sufficient to wash a load of laundry and, at the same time, do not exhibit a greasy or sticky feel which would be objectionable to users. In addition, the meltblown webs of this invention release the detergent over a sustained period of time, thereby improving washing efficiency.

The product can be dispensed in sheet form or from perforated rolls. In addition, the single sheets can be perforated to be torn in half for half loads of laundry.

The meltblown substrate can be any meltblown web made from a thermoplastic polymer having a softening point greater than 220° F. Polymers which soften at lower temperatures may melt if exposed to clothes dryer temperatures. A preferred polymer is polypropylene, which is the most commonly used polymer for making meltblown webs. The process for making meltblown webs is well known in the art and is used extensively for manufacturing a wide variety of commercial nonwoven products. A representative example of the meltblowing process is disclosed in U.S. Pat. No. 3,978,185 to Buntin et al. dated Aug. 31, 1976. It will be appreciated, however, that other meltblowing process will produce webs suitable for purposes of this invention. The meltblown web can be combined or laminated to other supporting webs, such as spunbonded webs, in order to impart strength or other attributes to the product.

The basis weight for a single sheet of the meltblown webs of this invention can range from about 80 to about 300 grams per square meter. Preferably the basis weight will be from about 110 to about 250, and most preferably about 180 grams per square meter. Basis weights lower than the abovesaid range lack sufficient pore volume to hold the necessary amount of liquid detergent. Basis weights greater than the abovesaid range are too difficult to manufacture. It is within the scope of this invention, however, to incorporate more than one ply into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations.

The liquid detergents useful for making the products of this invention can be any liquid detergent which is suitable for cleaning laundry. As is well known in the detergent arts, these detergents typically contain a large number of components such as surfactants, solubilizers, pH adjusters, fragrances, brighteners, dyes, anti-redeposition compounds, and builders. For purposes of processing, as will be explained herein, it is preferable that the liquid detergent contain at least 60 weight percent active detergent solids in order to minimize drying costs, although liquid detergents having at least 25 weight percent solids are suitable.

It is preferred that the meltblown web also contain a fabric softener which softens the laundry during the drying cycle. Webs impregnated with such softening agents are well known in the art and are well known commercial products. Suitable fabric softening agents include those described in U.S. Pat. No. 3,686,025 to Morton, dated Aug. 22, 1972.

BRIEF DRSCRIPTION OF THE DRAWING

FIG. 1 is a schematic view of a process for making the product of this invention.

DETAILED DESCRIPTION OF THE DRAWING

Figure 1:
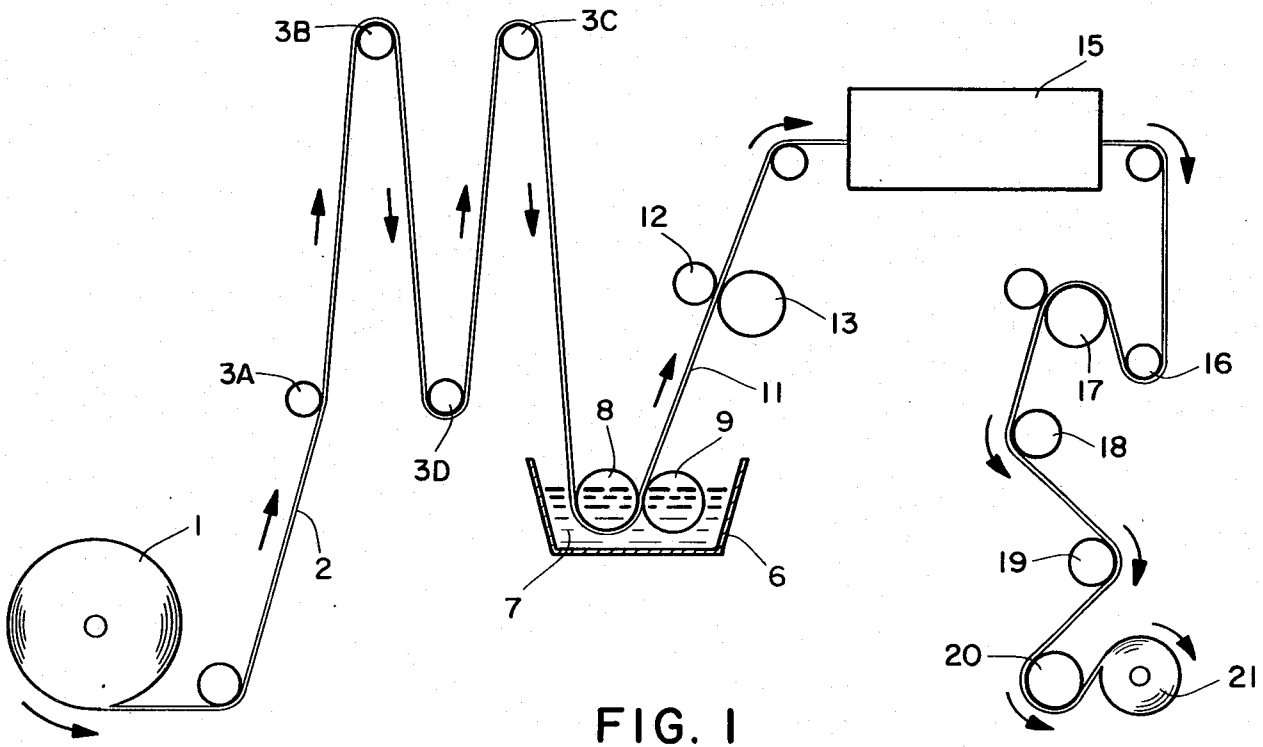

Directing attention to FIG. 1, shown is a supply roll 1 of the meltblown web material to be saturated with liquid detergent. Preferably the web has been thermally pattern-bonded to provide sufficient integrity to withstand a wash and dry cycle without disintegrating. The web 2 is passed through a series of tension control rolls 3A, 3B, 3C, and 3D and fed to the saturation station 5. The saturation station consists of a tray 6 filled with liquid detergent 7 and a guide roll 8 which submerses the web. The space between the guide roll and the metering roll is set in order to control the amount of add-on to the web. The residence time of the web in the liquid detergent is short but sufficient to substantially saturate the web. Generally residence times on the order of one or two seconds are suitable.

After leaving the saturation station, the saturated web 11 passes through a controlled nip between nip rolls 12 and 13 which serves to squeeze out excess liquid and provide an additional degree of control over the amount of liquid contained within the web and its even distribution throughout.

The saturated web then passes through a dryer 15, preferably an air flotation dryer, which removes substantially all (about 95 percent) of the available moisture to condense the liquid detergent. The product leaving the dryer contains concentrated liquid detergent having a gel-like consistency, yet the web feels dry to the touch.

After drying, the dried web passes around a tension control roll 16, a pull roll 17, a slitter roll 18, a Mount Hope roll 19, and a rewind drive roll 20. The web is thereby wound onto the rewind roll 21 for subsequent converting and packaging operations.

EXAMPLES

Example 1

A laundry cleaning product was made using the method described in connection with FIG. 1. A thermally pattern-bonded web of polypropylene meltblown material having a basis weight of 110 grams per square meter was passed through the dip tank at a speed of 17 feet per minute. The dip tank contained a liquid detergent solution of Watkins Concentrated Heavy Duty Liquid Detergent. The residence time of the web in the liquid detergent was 1.8 seconds. The active solids content of the detergent solution was 63 weight percent. The gap between the guide roll and the metering roll was 0.030 inch.

After the web exited the dip tank, the detergent-containing web was dried in an air flotation dryer to remove substantially all free water. The resulting web contained about 175 grams of condensed liquid detergent per square meter. The web was then wound onto a take-up roll.

Product samples having a size of 11×14 inches were cut from the take-up roll and tested for washing efficacy. The products exhibited good washing efficacy and had only a slight oily feel.

Example 2

The method described in Example 1 was repeated using a polypropylene meltblown web having a basis weight of 140 grams per square meter. Because of the heavier basis weight, the gap between the guide roll and metering roll was increased to 0.040 inch. The solids add-on for the resulting product was 202 grams per square meter. Product samples were cut from the take-up roll to a size of 11×13 inches and exhibited good washing efficacy.

Example 3

The method described in Example 1 was repeated using a polypropylene meltblown web having a basis weight of 180 grams per square meter. The gap between the guide roll and metering roll was 0.050 inch. The solids add-on for the resulting product was 259 grams per square meter. Product samples were cut from the take-up roll to a size of 11×10 inches and exhibited good washing efficacy.

It will be appreciated that the foregoing examples, shown for purposes of illustration, are not to be construed as limiting the scope of this invention.

We claim:

1. A cleaning product comprising a meltlown web saturated with at least 150 grams per square meter of condensed liquid laundry detergent having a gel-like consistency.

2. The product of claim 1 wherein the basis weight of the meltblown web is from about 80 to about 300 grams per square meter.

3. The product of claim 2 wherein the amount of condensed liquid detergent is from about 190 to about 300 grams per square meter.

4. The product of claim 3 wherein the size of the meltblown web is from about 200 to about 2,000 square centimeters.

5. The product of claim 4 wherein the meltblown web is pattern bonded.

6. A laundry cleaning product comprising a pattern-bonded polypropylene meltblown web having a basis weight of about 180 grams per square meter, said web being saturated with at least about 200 grams of condensed liquid detergent per square meter.

7. The product of claim 6 wherein the size of the web is about 800 square centimeters.

* * * * *

UNITED STATES PATENT AND TRADEMARK OFFICE

CERTIFICATE OF CORRECTION

PATENT NO. : 4,793,941

DATED : December 27, 1988

INVENTOR(S) : P. J. Serbiak, E. G. Greenman, G. L. Shanklin

It is certified that error appears in the above-identified patent and that said Letters Patent is hereby corrected as shown below:

In the inventor's block, add: -- Roger A. Johnson, Appleton, Wisconsin.--

Signed and Sealed this

Twenty-fourth Day of October, 1989

*Attest:*

DONALD J. QUIGG

*Attesting Officer*

*Commissioner of Patents and Trademarks*